United States Patent [19]

Spector

[11] 4,388,490

[45] Jun. 14, 1983

[54] EFFECTS BOX SYSTEM AND METHOD

[76] Inventor: Abner Spector, 1710 Avenida Del Mundo #803, Coronado, Calif. 92118

[21] Appl. No.: 150,813

[22] Filed: May 19, 1980

[51] Int. Cl.[3] ..... H04R 3/12

[52] U.S. Cl. ..... 179/1 B; 179/1 PC; 179/1 SW; 361/391; 361/394

[58] Field of Search ..... 179/1 PC, 1 D, 1 SW, 179/91 R, 98, 1 B, 1 M; 339/17 B, 17 M; 84/1.24, DIG. 17, DIG. 29; 361/337, 390, 391, 393, 394, 399, 412, 415, 339, 361, 395

[56] References Cited

U.S. PATENT DOCUMENTS

| | | | |
|---|---|---|---|
| 3,270,253 | 8/1966 | Binder et al. | 361/391 |
| 3,482,147 | 12/1969 | Kersten | 361/390 |
| 3,767,974 | 10/1973 | Donovan, Jr. et al. | 361/415 |
| 3,767,975 | 10/1973 | Glenn | 361/415 |
| 3,823,245 | 7/1974 | Suzuki . | |
| 3,842,212 | 10/1974 | Miller | 179/91 R |
| 3,917,370 | 11/1975 | Thornton et al. | 361/415 |
| 4,012,610 | 3/1977 | Ericson et al. | 361/339 |
| 4,030,397 | 6/1977 | Nelson | 84/1.24 |
| 4,115,665 | 9/1978 | Giacoppo et al. | 179/1 PC |
| 4,251,853 | 2/1981 | Sites | 361/394 |

*Primary Examiner*—G. Z. Rubinson
*Assistant Examiner*—Randall P. Myers
*Attorney, Agent, or Firm*—Laurance E. Banghart; David J. Harshman

[57] ABSTRACT

A method for changing each of and/or arranging the sequential order of audio effects circuit modules constructed to be received in any electronic system so predisposed, noiselessly, without the generation of spurious noise signals into the main signal path of the system, during performance and all stages of operation, maintaining, all the while, the uninterrupted flow of the main signal path through the system. The effects box described herein includes a main housing containing a main circuit apparatus, and having module-receiving recesses. Modules each have multiple module contact elements positioned to contact corresponding recess contact elements when the module is installed.

Switching means are provided which disconnect the recess contact elements from the main audio path upon insertion, or removal, of a module, while maintaining continuity of said main audio path, and which further direct the audio signal through said audio effects circuit module only after solid physical and electronic contact has been made.

3 Claims, 21 Drawing Figures

14
18
-5V
+5V
7
8
9
50K
10
1.5M
11
500K
12
500K
6
100K
5
100K
100K
-9V
+9V
+18V
4
D.P.,D.T.
MOMENTARY
MAIN SIGNAL INCOMING
NC
S.P.,S.T.
NC
15
#22 INPUT
#22 OUTPUT
MAIN SIGNAL
TO NEXT #4, (#2) OR OUT

EFFECTS BOX SYSTEM AND METHOD

BACKGROUND OF INVENTION

Music and/or audio signal processing circuitry has become important in the field of audio electronics in connection with the electronic modification of electrically amplified musical audio signals or the production thereof. A wide variety of circuit designs have been developed and are constantly being developed to deliver new and interesting sounds in live performances, recorded performances, or the modification of recorded performances.

These circuits are considered componential and appear on the market, quite often, in modular form, self-contained and equipped to be linked to an audio system. In numbers, these become difficult to handle and once linked to a system, the changing of their sequence becomes a spaghetti-like affair, in that cords or cables, must be reckoned with. And a musician using these, in numbers, is, during a live performance, usually confined to the sequencing originally established. Flexibility is at a minimum.

Some systems have a feasible number of these incorporated in them, and, in some cases, a switching arrangement allows complete sequencing flexibility; but in larger numbers, this becomes less and less feasible. Thus, many operators of these systems add to their system a desired number of the abovedescribed modular components, and this operation becomes a combination of the two.

The device and method for which a patent is herein applied is based upon neither of the above with respect to sequencing or changing of components, i.e., effects.

The use of these circuits, i.e., effects, would be enhanced if such circuits could be easily changed and resequenced, particularly during a performance, without disturbing the continuity of the audio signal being delivered in the performance, or introducing spurious signals into the performance, and if such a system could be compacted to a relatively small size and weight, be of a relatively low cost, and allow the consumer the use of a wider number and variety of circuits than is generally feasible in a large system.

SUMMARY OF THE INVENTION

A method and system of changing, or substituting one for another, and of organizing, arranging and rearranging the sequential order of component circuits having particular sound effect functions, housed as modular components in the form of circuit-bearing cartridges or audio effects circuit modules, in any electronic audio system so predisposed, in a manner that, in effect, provides for noiseless (i.e., non-generation of spurious signals into main signal path), uninterrupted main signal path flow through said system, during performance, i.e., during operation of said system.

Said method is incorporated in an audio signal processing unit or system commonly known in the vernacular as an effects box. The arrangement for processing audio signals includes a main housing containing a main circuit apparatus, and having module-receiving recesses. Modules, containing any of a wide variety of componential signal processing circuits well known in the art and each having at least one input and one output, can be received in said recesses, so that each module can control the incoming audio signal in a unique way to provide a different sound output. A multiple of mother module controls, i.e., external controls of the module circuit, consisting of switches and potentiometers, are positioned on the main housing immediately adjacent to and surrounding, at least partially, said recess. Each module has markings identifying its circuitry function and indicating which controls on the main housing control module operation. The module has multiple contact elements positioned to contact corresponding main circuit contact elements connected to main circuit and positioned on the front side of the far end of said recess and mounted on an elastomeric sheet, i.e., a foam slab mounted thereon. Initial contact is made at a predetermined depth of insertion of the module, and full contact is made just before full insertion and then held upon the seating, or locking, of said module in said recess. A mechanism, i.e., a switch-coupled latch is positioned on said main housing as a means, in part, for the expulsion or partial ejection of the module from the recess, in reverse of said locking via said mechanism.

In order to avoid the generation of spurious signals into said main signal path during the changing of a module, and in order to maintain the integrity, i.e., the uninterrupted flow, of the main signal path through the system, even while a recess is partially or fully devoid of a module, a combination of electro-mechanical mechanisms, such as a switch-coupled latch, two switches, and foam slab provides that during all stages of operating and operation, said main signal is noiselessly routed with respect to a recess either: (a) into and out of said recess and its locked-in module; (b) connected as a "bypass" of said recess; (c) connected to "pass-it-by" as described hereinafter.

Included in said main circuit apparatus and said main housing are the following conventional things: input and output jacks and their respective attenuators (potentiometers); one buffer-amplifier (at the input jack); a conventional, conventionally sophisticated a.c. to d.c. power supply, and other conventional necessities and accessories.

The module can be shaped in the form of an unopened deck of playing cards, of light-weight break-resistant type plastic, devoid of protuberances, devoid of its own necessary external controls, and as such, be of a minimal costs, compactly storable and portable, as opposed to conventional effects, whose housings are, normally, of heavy gage metal, contains its own power supply, its own external controls, its own input and output jacks, and once linked to a system, cannot be relinked in a different sequential order with the ease and facility provided by the invention herein, especially during a live musical, or otherwise, performance.

The novel features of the invention are set forth with particularity in the appended claims. The invention will be best understood from the following when read in conjunction with the accompanying drawings.

DETAILED DESCRIPTION OF THE PREFERRED EMBODIMENTS

Figure 1:
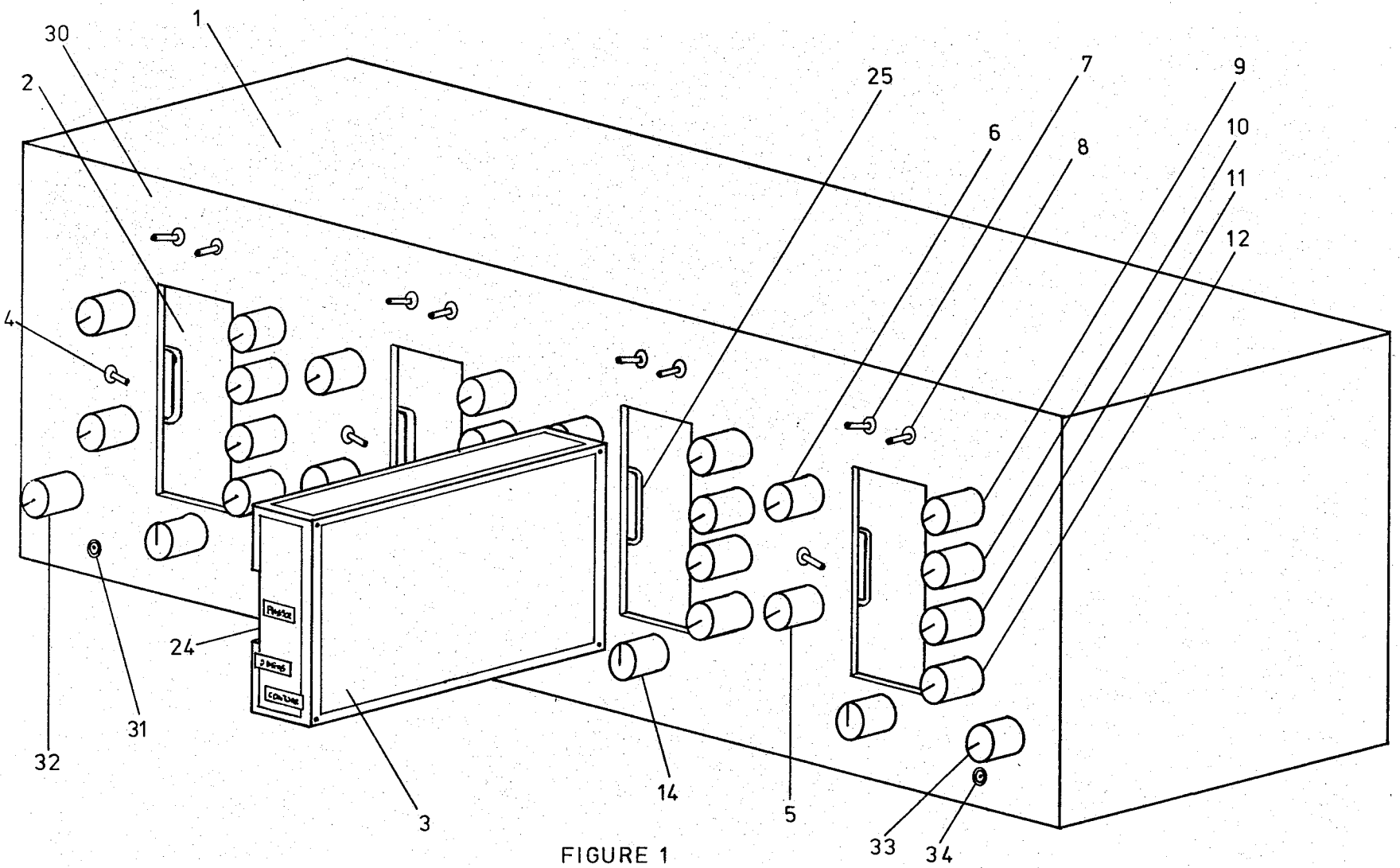
FIG. 1 is a perspective and partially exploded view of an audio signal processing system ("effects box") constructed in accordance with the present invention.

FIG. 1 illustrates a view of an audio signal processing unit or system, "effects box", which includes a main circuit apparatus having a main incoming audio signal input source terminal (not shown), a main housing 1 having module-receiving recesses 2 designed to receive one or more module(s) 3. Said modules are, of course, reciprocally designed to fit into said module-receiving recesses.

Each module 3 can contain in its module housing 3*h*, any of a wide variety of audio signal processing circuits, commonly called "effects", which can perform a particular function on the incoming audio signal or the main signal path of said main circuit in a unique way to provide a different sound output, as are well known in the art.

Figure 5:
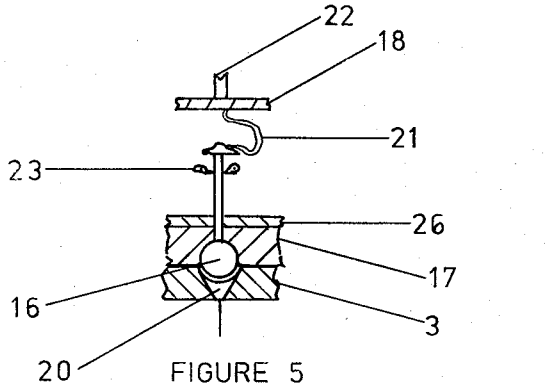
FIG. 5 is a partial sectional view of a portion of the apparatus of FIG. 4, in a fully inserted position.
Figure 4:
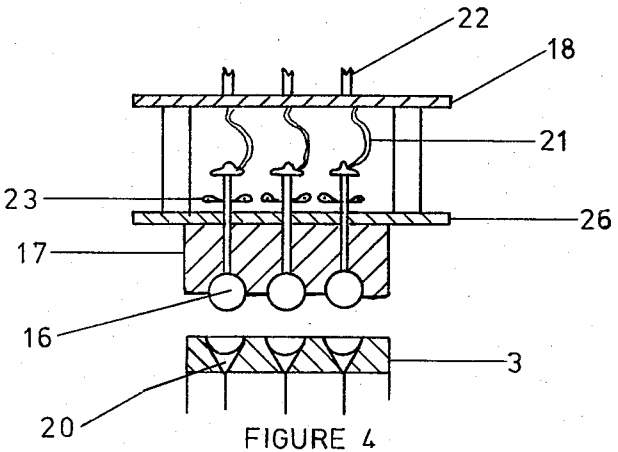
FIG. 4 is a partially sectional view of the apparatus of FIG. 3, with the module in a partially inserted position.
Figure 3:
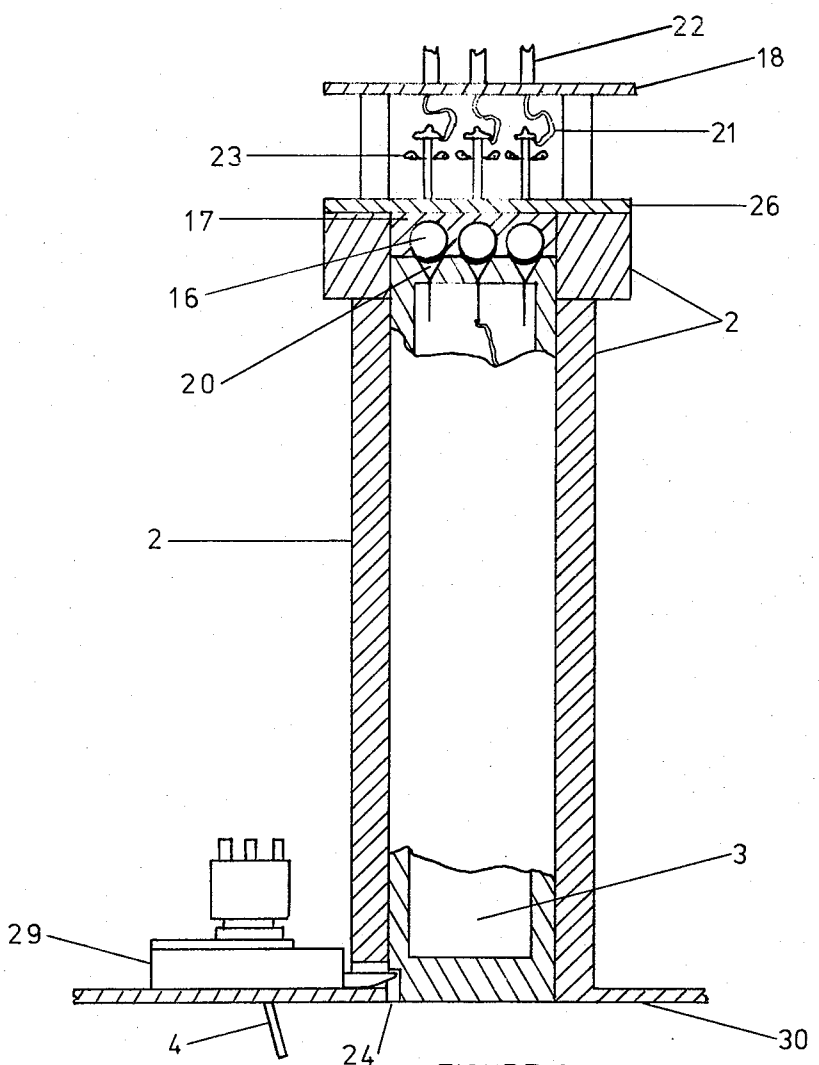
FIG. 3 is a partial sectional view of the apparatus of FIG. 2, shown with the module in fully inserted position.
Figure 6B:
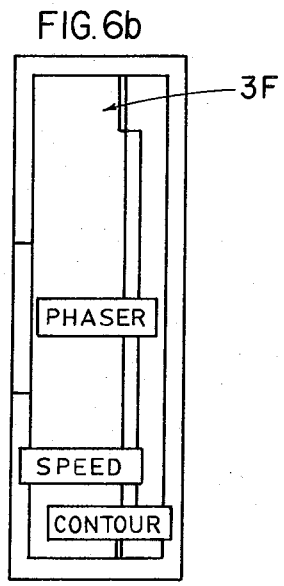
FIGS. 6A–6E are perspective views of a module assembly.
Figure 6A:
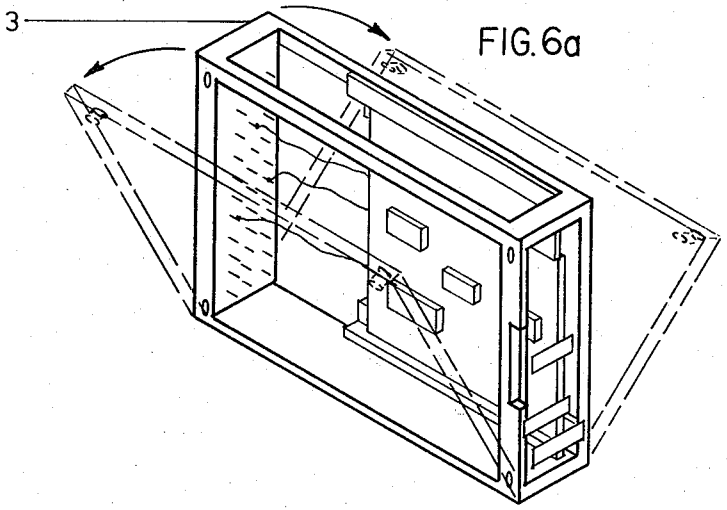
Figure 6E:
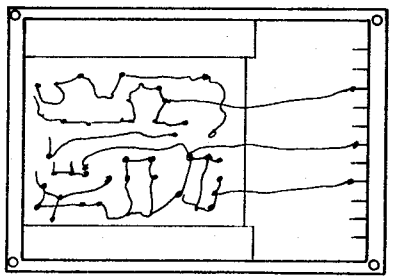
Figure 6D:
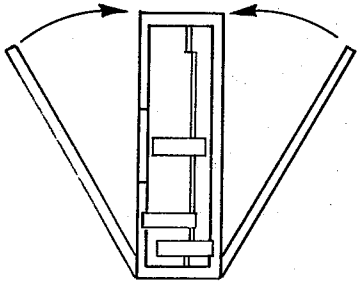
Figure 6C:
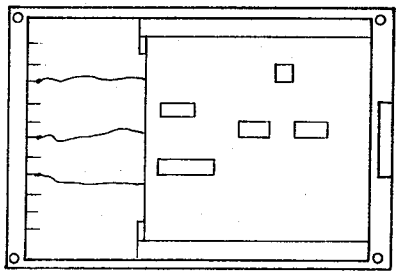
Figure 7B:
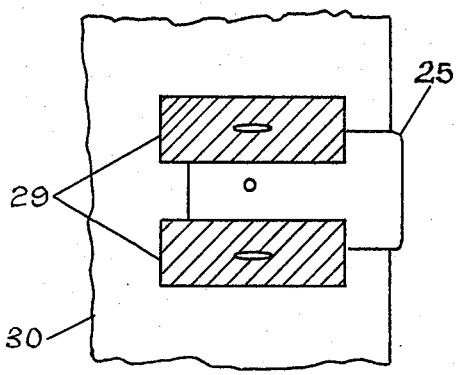
FIGS. 7*a*–7*i* are a multi-view of a latch-coupled switch assembly showing lock-in of a module.
Figure 7F:
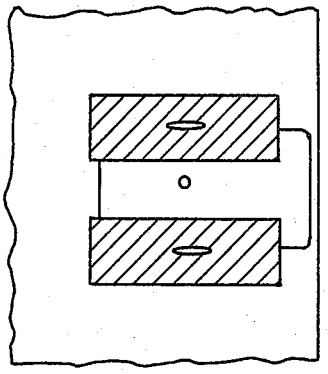
Figure 7A:
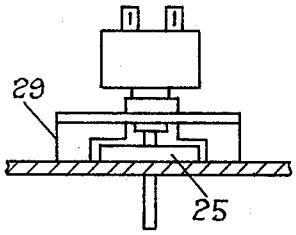
Figure 7C:
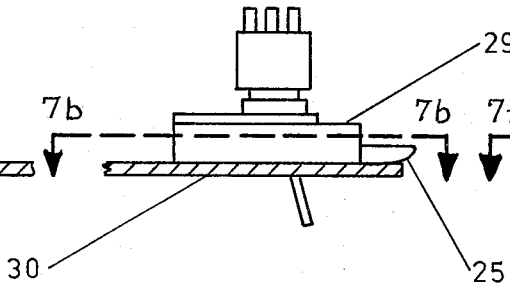
Figure 7G:
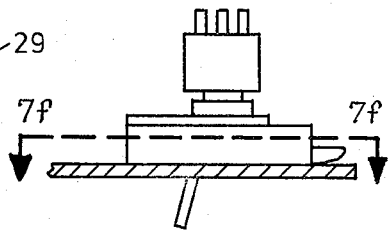
Figure 7D:
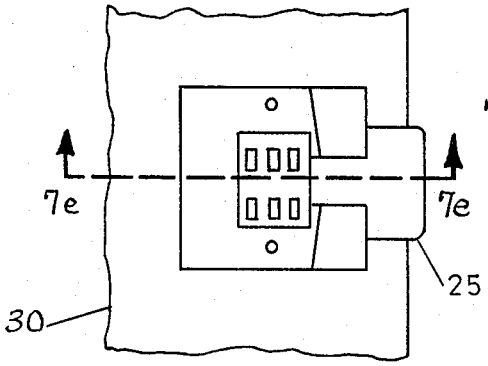
Figure 7H:
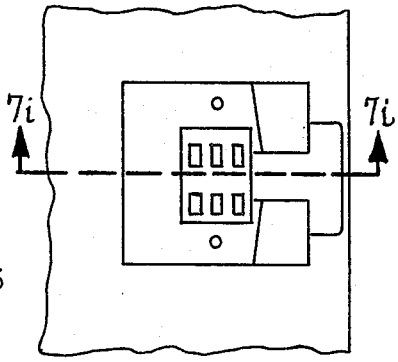
Figure 7E:
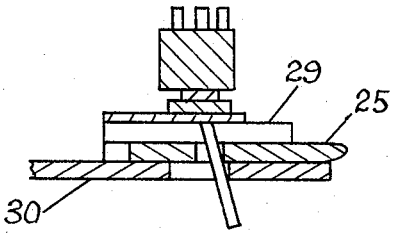
Figure 7I:
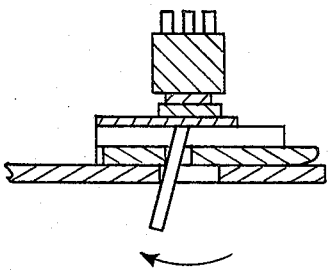

The module housing 3*h* has embedded in it a multiple of module contact elements 20, as shown in FIGS. 3, 4, and 5 positioned to contact recess contact elements 16, as shown in FIGS. 3, 4, and 5 upon installation of module 3 into recess 2.

A group of potentiometers and switches 5, 6, 7, 8, 9, 10, 11, 12, called mother module controls are positioned on main housing 1 immediately adjacent to recess 2, and have all of their respective terminals connected only to their respective preassigned recess contact elements 16, an identical group surrounding each recess and so positioned and connected so that said group of controls are not a part of and have no effect upon the said main circuit or system until and as of when a module 3 is fully installed in the recess 2. While a module 3 is so fully installed, said group of controls serve as the external controls of module 3, to control the operation of its circuit as is well known in the art.

Markings on the face end 3*f* of each of module 3 (see FIGS. 6A–6E) identify its particular function performed by its particular effect circuit, and indicate which of said controls control the module's operation. When fully installed in a recess, said face end 3*f* of module is flush with the control panel 30 of said main housing 1 and said markings contain arrows pointing to the controls on said control panel 30 to be used with respect to the module's circuit and their respective control functions.

FIGS. 2, 3, 4, 5, illustrate the manner in which recess contact elements 16 are mounted and positioned and make contact with module contact elements 20. An elastomeric member, such as a foam slab 17, is positioned on the front side of the far wall 26 of recess 2. As can be seen in greater detail in FIGS. 4, 5, recess contact elements 16 are positioned and embedded, somewhat, in foam slab 17, so that their pins project through foam slab 17 and through their respective guide holes in far recess wall 26, retained there by retainers 23, connected via thin flexible, insulated wires 21 to junction pins 22 which are molded into and project through recess terminal junction panel 18. It is at this panel 18 that said main circuit and said controls 5 through 12 are connected to appropriate recess contact elements 16. In this manner recess contact elements 16 have individual compressive sliding action through said guide holes.

FIG. 4 further shows the state of recess contact elements 16 before corresponding contact is made with module contact elements 20. FIGS. 5 and 3 show the state of recess contact elements 16 in their compressed full contact with module contact elements 20 when module 3 is in a fully installed position.

This unit, or system, or "effects box" provides demonstrably a practical application and use and one objective of said unit is to provide a versatile means for modifying an audio signal from an external audio signal source via said audio effects circuit modules 3 and delivering the modified signal to an audio system.

The main signal path flow of said audio signal or routing through said unit is a basic series circuit, taking said main signal into and out of a recess 2 and its audio effects circuit module 3, then into and out of the next recess 2 and its audio effects circuit module 3, and so on, in series, except for the following.

When a said recess 2 is devoid of a module 3, then said recess 2, with respect to said main signal, is in a "bypass" state. When a module 3 is in said recess 2 in any position other than said fully installed or fully inserted, locked-in position, said recess 2, again with respect to said main signal, is then in a "pass-it-by" state wherein the recess contact elements are electronically disconnected from said main audio signal path.

A fuller outline of said basic series circuit routing of how said main signal path is connected is as follows:

Said external audio signal source is accepted at input jack 31, to an input attentuator potentiometer 32, to input of a conventional buffer-amplifier as part of said main circuit apparatus not shown, and output of said buffer-amplifier to first said recess 2, or "passes" by it, and so on as previously described to output attentuator potentionmeter 33, to output jack 34, delivering said modified signal, or unmodified signal if each of said recesses 2 is devoid of or contains, as previously described, a partially installed module 3, to a said so receptive audio system.

FIGS. 7*a*–7*i* illustrate an assembly which provides, among other things to be described herein, the means for the locking-in of a fully installed or fully inserted module 3 in a recess 2, and for the unlocking, freeing, of module 3 from recess 2.

Figure 2:
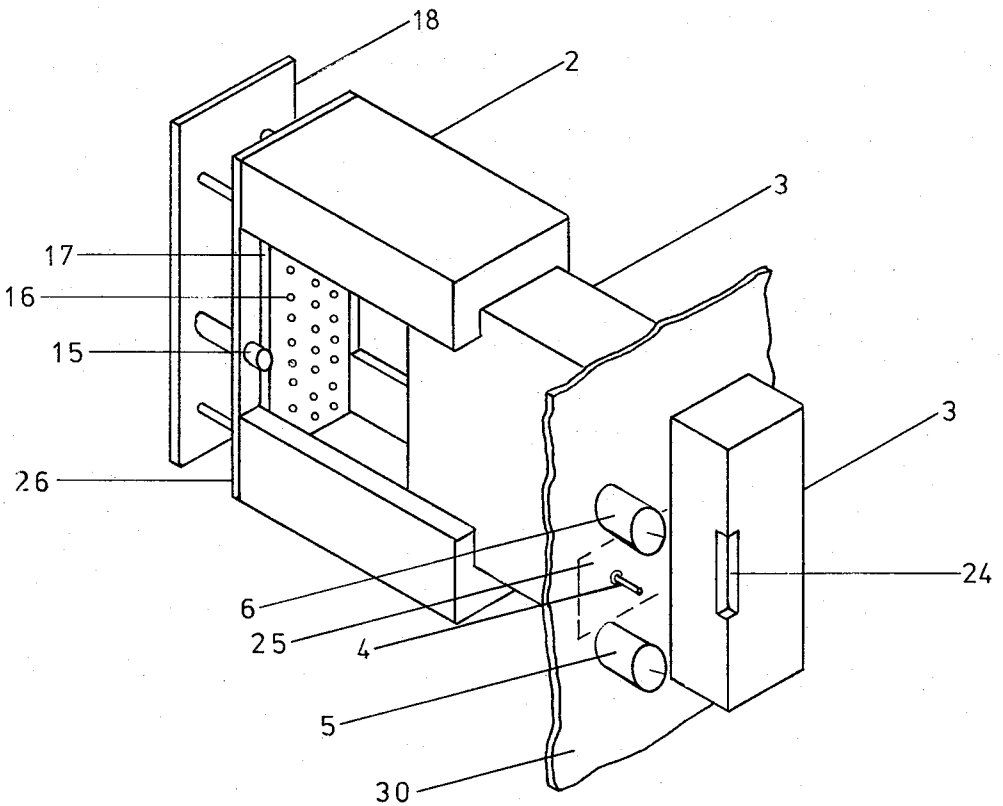
FIG. 2 is a partial perspective view of the system of FIG. 1, showing a module thereof in a partially inserted position.

FIGS. 1, 2, 3, show the position the position of said assembly on control panel 30 of main housing 1.

As can be seen, latch 25 is coupled to the handle of monetary toggle switch 4 and is held slidably captive by u-bracket 29 against the inner surface of control panel 30. Switch 4 is attached to u-bracket 29 so that handle of switch 4 projects through the coupling hole of latch 25 and through control panel 30 making said handle accessible to manual finger tip manipulation or displacement of it. In their simultaneous normal positions, said handle of switch 4 rests laterally against side of hole in control panel 30, and the quarterrounded end of latch 25 projects slightly into recess 2. FIGS. 7*a*–7*i* further shows the simultaneous displaced or momentary positions of switch 4 and latch 25 via arced arrow and the markings, respectively 4a and 25a.

Therefore, noting again the position of said quarter-rounded end of latch 25 projecting slightly into recess 2 area its normal, at rest, position can be explained hereinafter.

A slight insertion of a module 3 into a recess 2 displaces, brings to their momentary positions, latch 25 and, simultaneously, handle of switch 4. When module 3 reaches its fully inserted and fully installed position in recess 2, said latch 25, under the inner spring force of switch 4, via said handle of switch 4, springs back to its normal position, into locking-notch 24 of module 3 as shown in FIGS. 1, 2, 3, and 6 thereby locking and holding said module 3 in said fully installed position in recess 2.

A slight left lateral manual or fingertip manipulation of said handle of switch 4 again displaces and brings to their simultaneous momentary positions, said handle of switch 4 and latch 25, allowing said module 3 to be partially expelled or ejected to an inch or so of ejection, allowing free and complete removal of module 3 from recess 2; whereupon, said handle of switch 4 and latch 25 simultaneously spring back to their normal, at rest, positions.

FIG. 2 illustrates the position of a momentary push-button switch 15, on recess wall 26, abutting said foam slab 17.

The present invention permits one to change and/or arrange and rearrange the sequential or serial order of modules in said "effects box", in a manner so that the only effect upon the main signal path flow through the system by and during all stages of the insertion and removal of a module is the quiet appearance of the intended "effect" of the module's componential circuit, or, respectively upon removal of module. quiet disappearance.

Figures 8, 9:
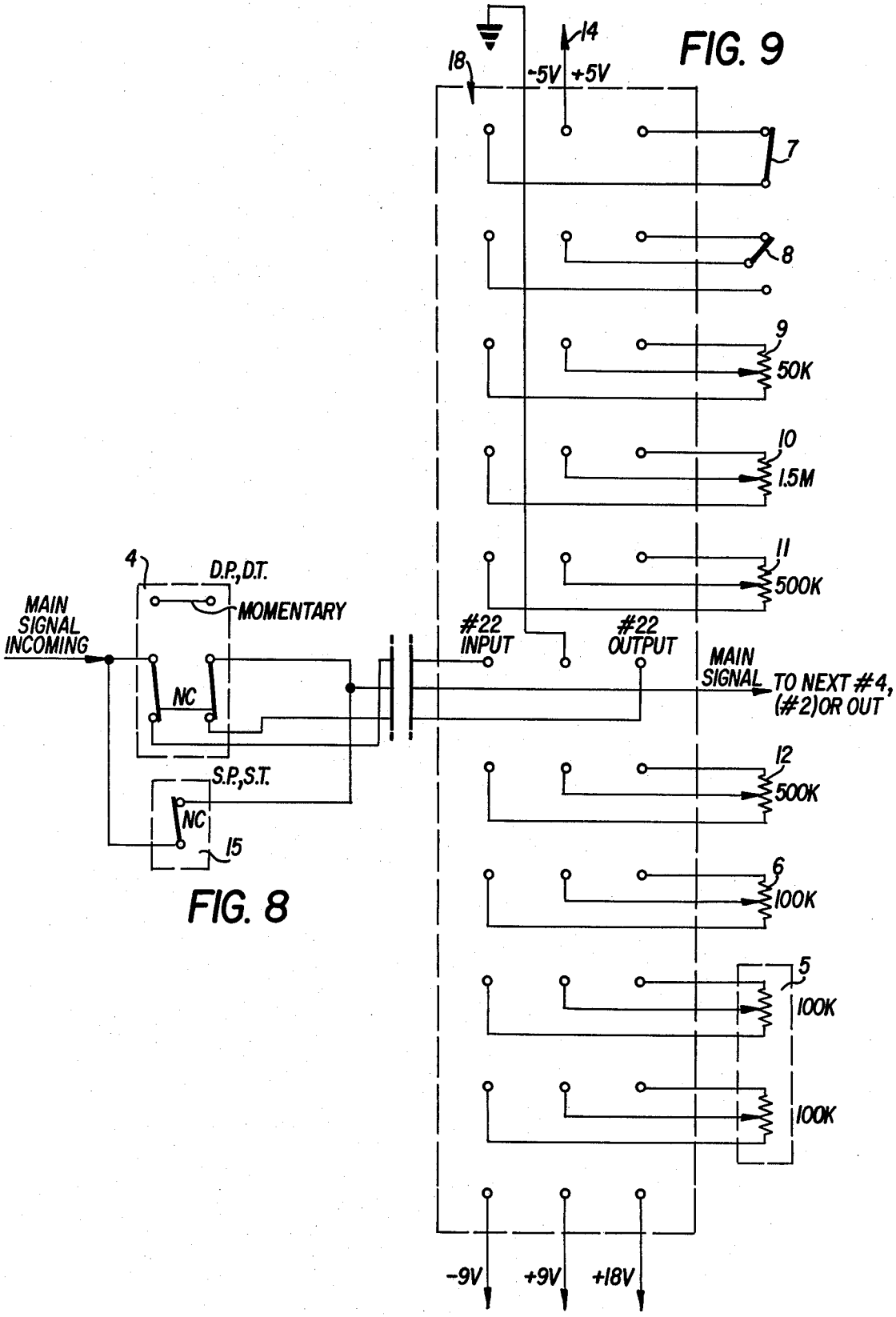
FIG. 8 is a sectional schematic of conjunctively working switches.
FIG. 9 is sectional view of junction panel of a recess indicating various branches of circuitry connection to recess and thus to installed module.

FIGS. 8 and 9 illustrate, in a sectional schematic, the flow of said main signal path with respect to a recess 2, i.e., its passing around, and its entrance to and exit from said recess 2 and its module 3 via #22 input and #22 output terminals per the conjunctive working of switch 4 and switch 15.

Switch 4 is a double pole, double throw, momentary toggle switch whose normal position is closed. Switch 15 is a single pole, single throw, momentary push-button switch whose normal position is closed, i.e., on. Connected as schematically indicated, with the centers of switch 4 breaking and being the pivotal connection of said main signal, its momentary poles wired to each other as the "pass-it-by" pivot and its normally closed poles being, respectively, said 'entrance to and exit from' pivot, and with said centers connected, further, to the terminals, respectively, of switch 15.

When a recess 2 is empty, devoid of a module 3, both of said switches 4, 15 are in their respective normal, normally closed, positions, and, as such, switch 15, via switch 4, has recess 2 in a "bypass" not "pass-it-by" state, in the conventional sense of conventional component bypass circuitry, i.e., disconnecting the output or shorting and connecting input to output but leaving both still connected to recess 2 via its input and output contact elements 16.

A slight insertion of a module 3 into a recess 2, displaces latch 25 which simultaneously displaces switch 4 to its momentary position which is now circuited in concert with switch 15, still in its "bypass" state. Upon further insertion, to a predetermined depth of insertion, module 3 engages push-button of switch 15, displacing to its momentary position switch 15, opening its contacts and taking it out of the circuit, which simultaneously allows switch 4 to function in its momentary, "pass-it-by" state. Both, the input and the output legs of the main signal path, though now connected, are each, respectively disconnected from contact elements 16 of recess 2. A slight but fuller insertion of module 3 brings the initial meeting, and the first physical, but not necessarily precisely simultaneous, contact between all respective and corresponding module contact elements 20 and recess contact elements 16. This is a critical point, a point at which spurious signals might be generated into the said main signal path, were it not for the fact that, switch 4 is in its "pass-it-by" state. At a fuller depth of insertion, after solid physical and electronic contact has been made or established between all just said contact elements, said fully inserted position of module 3 is reached, at which point, as earlier described, latch 25 springs into locking notch 24, as simultaneously switch 4, now, too, in its normal, normally closed position, thereby directs and allows said main signal to flow, via #22 input and #22 output, into and out of recess 2 and its locked-in and now operative and/or operating audio effects circuit module 3.

Noting the now fully compressed states of switch 15 and foam slab 17, it can be seen how foam slab 17 maintains the integrity of contact between module and recess contact elements. Foam slab 17 and switch 15 conjunctively stabilize module 3 in its locked-in position in recess 2, via their respective compressive and/or decompressive forces.

The removal of module 3 from recess 2, in the manner earlier described, provides an exact reverse of the sequence of events just described, including the said partial expulsion and/or ejection of module 3 from recess 2, via said compressive and/or decompressive forces.

FIG. 9 further illustrates a sectional schematic sketch of the back or terminal 22 side of junction panel and/or wall 18, indicating the various circuitry branch connections to terminals 22 for controlling the effects circuit which is not shown as it is well known in the art.

Potentiometer 14 of FIGS. 1, 9, positioned on control panel 30, functions as a bias control to those of modules 3 whose circuitry design is such that requires variable bias control.

In order to maximize noiseless switching functions, said switches 4 and 15 can be of the necessary number of poles to be circuited to actuate and accomplish conventional electronic switching, e.g., integrated-circuit switching.

Included in said main circuit apparatus, is a conventional but conventionally sophisticated sectioned and filtered a.c. to d.c. power supply, feeding sectionally and respectively, the various d.c. potentials to all components as required.

A module can be constructed in any feasible size, shape and material, with contact elements of any correspondingly feasible size or shape, and placed on any end, edge or side of its housing to match a correspondingly constructed module-receiving recess. FIGS. 6A–6E illustrate assembly views of module 3, indicating removable sides, placement of the effects circuit board and its circuit, circuit connecting to contact elements, and face markings.

FIG. 1 illustrates, indicates, four module-receiving recesses 2, but a unit such as herein can be constructed containing any feasible number of module-receiving recesses, even, if so desired, a number of just one recess and still be a system which is useful and practical.

Thus, the invention provides a method and system which is versatile to permit the use of a wide variety of componential effects circuits in a relatively inexpensive and compact unit, with modules that can be made of an optimal size and shape, conveniently storable and portable, at a minimal cost.

No detailed original componential circuitry has been presented, or intentionally implied, herein. All component effects circuits for performing particular functions are known in the art and may be modified to the extent of adaptation to use said group of controls 5 through 12, with their predetermined set of various variable resistance values, potentiometers, numbers of poles and throws, and switches to accommodate corresponding modular circuit design modification.

Although particular embodiments of the invention have been described and illustrated herein, it is recognized that modifications and variations may readily occur to those skilled in the art and consequently, it is intended that the claim be interpreted to cover such modifications and equivalents.

I claim:

1. A system for noiselessly operatively inserting at least one audio effects circuit module into a main audio path having a source audio signal without introducing spurious noise signals, while maintaining continuity of the audio path, comprising:

(a) an audio effects circuit module which provides audio effects, said audio effects circuit module having module contact elements including at least one input terminal and at least one output terminal, wherein said output terminal provides the audio effects;

(b) a main housing having a main input terminal for connecting a main incoming source audio signal to the audio path and having a main output terminal, said main housing further having at least one recess for receiving said audio effects circuit module, said recess having recess contact elements mounted and positioned thereon to make corresponding contact with said module contact elements when said module is fully inserted into said recess;

(c) first switching means associated with the audio path and with said recess contact elements for maintaining the continuity of the audio path when said recess is devoid of said audio effects circuit module; and (d) second switching means associated with the audio path and with said recess contact elements, said second switching means being responsive to partial insertion of said audio effects circuit module into said recess for electrically disconnecting said recess contact elements from the audio path, while maintaining continuity of the audio path, so that the first physical contact between said module contact elements and said corresponding recess contact elements is made remote from the audio path, said second switching means further being responsive to full insertion of said audio effects circuit module for electrically connecting said recess contact elements to the audio path only after physical and electronic contact between said module contact elements and said corresponding recess contact elements has been solidly made, for noiselessly operatively connecting said module input and output to the audio path thereby inserting said audio effects circuit module into the audio path without introducing spurious noise signals.

2. The system of claim 1, for further noiselessly, removing at least one audio effects circuit module from the audio path, further comprising:

(a) said second switching means being further responsive to partial removal of said audio effects circuit module from said recess for electrically disconnecting said recess contact elements from the audio path prior to said solid physical and electronic contact between said module contact elements and said corresponding recess contact elements being disturbed by said removal, while maintaining the continuity of the audio path, thereby permitting removal of said audio effects circuit module from the audio path without introducing spurious noise signals.

3. The system of claim 2, further comprising a plurality of audio effects circuit modules and a plurality of recesses connected in electrical series, thereby permitting not only the noiseless changing of said audio effects circuit modules, but also the noiseless arranging and rearranging of the sequential order of said audio effects circuit modules, while maintaining continuity of the audio path.

* * * * *